United States Patent [19]

Kolmes et al.

[11] Patent Number: 4,936,085

[45] Date of Patent: Jun. 26, 1990

[54] YARN AND GLOVE

[76] Inventors: Nathaniel H. Kolmes, 1740 5th St. Dr., NW., Hickory, N.C. 28601; Harold F. Plemmons, Rte. #1, Box #628, Millers Creek, N.C. 28651

[21] Appl. No.: 366,885

[22] Filed: Jun. 13, 1989

[51] Int. Cl.[5] ..... D02G 3/18; D02G 3/36

[52] U.S. Cl. ..... 57/229; 57/210; 57/230

[58] Field of Search ..... 57/210, 229, 230, 231, 57/232, 235, 902

[56] References Cited

U.S. PATENT DOCUMENTS

| | | | |
|---|---|---|---|
| 2,335,644 | 11/1943 | Camp | 57/229 |
| 3,490,224 | 1/1970 | Bourgeas | 57/210 |
| 4,321,854 | 3/1982 | Foote et al. | 57/210 X |
| 4,384,449 | 5/1983 | Byrnes et al. | 57/210 |
| 4,470,251 | 9/1984 | Bettcher | 57/210 X |
| 4,777,789 | 10/1988 | Kolmes et al. | 57/210 |
| 4,838,017 | 6/1989 | Kolmes et al. | 57/210 |

*Primary Examiner*—Joseph J. Hail, III

*Attorney, Agent, or Firm*—Spencer & Frank

[57] ABSTRACT

An improved yarn, fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands is fiberglass, the non-fiberglass strands are preferably nylon or polyester.

13 Claims, 1 Drawing Sheet

YARN AND GLOVE

CROSS-REFERENCE TO RELATED APPLICATIONS

This application contains subject matter which is common to our pending application Ser. No. 07/176,075, filed Mar. 31, 1988, which was a continuation of application Ser. No. 06/766,846, filed Aug. 16, 1985, and now abandoned, and this application contains subject matter which is common to our co-pending application Ser. No. 07/202,338, filed June 6, 1988, which was a continuation of application Ser. No. 06/915,140, filed Oct. 3, 1986 and now U.S. Pat. No. 4,777,789, issued Oct. 18, 1988.

BACKGROUND OF THE INVENTION

The present invention relates generally to yarns, fabrics and protective garments knitted of such yarns and, more particularly, to an improved yarn which may be knitted into an improved, more comfortable, more flexible protective garment such as a glove.

Prior to the present invention, technological developments of cut resistant yarns for protective garments have followed essentially a two-pronged approach. The first approach was in connection with the use of Kevlar, which is a Dupont trademark for an aramid fiber, with the Kevlar fiber to be used in yarns for protective garments. By way of example and not by way of limitation, aramid fibers have been used to form yarns, with the yarns thereafter knitted to make protective garments, including protective gloves, as exemplified by Byrnes U.S. Pat. No. 3,883,898. In addition to the aramid yarn, aramid fibers have been used in combination with other materials such as wire to form a protective garment, such as a protective glove, with an increased/or cut-resistance. Examples of this concept may be found in Byrnes U.S. Pat. No. 4,004,295 and Byrnes et al. U.S. Pat. No. 4,384,449. This latter-most Brynes patent describes a particular yarn configuration, namely, a four-piece yarn configuration including a core and a covering. The core is composed of two parallel strands, one wire and one aramid fiber, and the covering is composed of two strand spirally-wrapped around the core, one clockwise and one counterclockwise, both of aramid fiber. This approach was expanded upon in Bettcher U.S. Pat. No. 4,470,251 where the yarn is made up of five pieces; three parallel strands comprising the core, and two wrappings comprising the cover. The Bettcher patent generally describes the core as comprising two wires and one aramid fiber, and the two wrappings with the first, or inner wrapping, being a high-strength synthetic fiber such as aramid and an outer wrapping preferably comprising three strands of nylon. This Bettcher patent further describes yet another version of the yarn, namely, a seven piece yarn with generally the same core as the five piece yarn. The first wrapping (closest to the core) is preferably an aramid. The next outermost wrapping is also an aramid, the next outermost wrapping is a three strand nylon, and the outermost wrapping is a three strand nylon.

In our prior applications, we disclosed the use of extended-chain polyethylene, such as the fiber manufactured by Allied-Signal, Inc., under the trademark Spectra in combination with other fibers and wire and in various configurations, for the purpose of an improved cut resistant or slash resistant yarn and garment. We explained the use of extende use polyethylene as avoiding numerous limitations and problems which occurred with the use of aramid fiber, such as, but not limited to, the fact that the polyethylene fiber has a substantially greater tensile strength than the comparable aramid fiber, the fact that polyethylene fiber is resistant to ultraviolet light and does not result in undesirable color change, as contrasted to aramid fiber, that the polyethylene fiber has increased abrasion resistance comparable to aramid, has only two-thirds of the density, has greater chemical resistance, and is inert, non-absorptive, non-allergenic and stable.

Unfortunately, there are certain limitations when extended-chain polyethylene fibers are utilized in a yarn for a protective garment. One of the most substantial limitations is that the extended-chain polyethylene fiber has an extremely limited heat resistance and, thus, when gloves knitted of yarns using extended-chain polyethylene are utilized, for example, in the food industry, the extended chain polyethylene fibers can not withstand the high temperature used for laundering and drying the gloves.

We overcame some but not all of these problems in a composite wire-fiber yarn and glove knitted therefrom, in the configuration described in our aforementioned U.S. Pat. No. 4,777,789, which illustrates various configurations of yarn in FIGS. 1, 2 and 5, the yarn including both wire and fiber, and we described how fibers, other than aramid and extended-chain polyethylene, may be used.

However, in many industries it is not desirable to utilize yarns and protective garments such as gloves which contain wire. As previously indicated, the wire may break and injure the hand of the wearer. In addition, gloves or garments made of yarn which contains wire will be electrically conductive, which is unsuitable for certain purposes. Wire, of course, is also thermally conductive.

Thus the yarns containing wire and either extended-chain polyethylenes, or aramids, have numerous limitations.

SUMMARY OF THE INVENTION

The present invention relates to a new and improved yarn and protective garment, such as a glove, formed of the yarn. This invention is based on our discovery that a cut-resistant or slash resistant yarn suitable for industrial use, can now be made from fibers which are free of wire, free of extended-chain polyethylene and free of aramid, while providing substantially the same cut resistance or slash resistance as the yarns and protective garments described in our prior applications and in the prior art referred to above.

The yarn and glove, according to the present invention, have numerous advantages over the prior art yarns and gloves as heretofore described, while maintaining substantial cut resistance and slash resistance, and the yarn, according to the present invention, may be formed on a conventional covering machine, may be utilized in conventional knitting or weaving machines and is of substantially lower cost than yarns which include the extended-chain polyethylene or aramid fibers.

BRIEF DESCRIPTION OF THE DRAWINGS

The various benefits and advantages of the present invention will be more apparent upon reading the following detailed description of the invention taken in conjunction with the drawings.

In the drawings, wherein like reference numerals identify corresponding components.

DETAILED DESCRIPTION OF THE INVENTION

Figure 1:
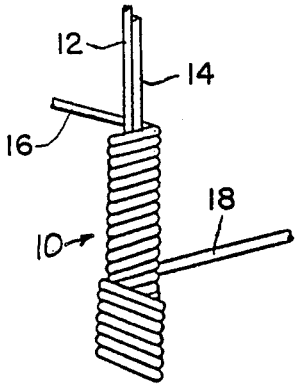
FIGS. 1 through 4 are illustrations of yarns in accordance with the principles of the present invention.

Referring first to FIG. 1, a yarn 10 is illustrated according to the principles of the present invention, the yarn including a core and a covering. The core is illustrated as having tWo strands 12, 14. The strands are illustrated as being placed parallel to each other, although it is within the spirit of the present invention that the core strands may be wrapped, twisted or braided together. The core strands include a first fiber strand 12 and a second fiber strand 14. The core strand 12 may be formed of fiberglass, and the core strand 14 may be formed of fiberglass, nylon, polyester, polycotton, asbestos, wool or regular (i.e., non-extended chain) polyethylene.

Surrounding the core is a covering comprising first and second strands 16, 18, wrapped in opposite directions relative to each other around the core. The covering strands may likewise be of fiberglass, nylon, polycotton, asbestos, wool, regular polyethylene or polyester.

With respect to the details of the fibers, the fiberglass may be either E-glass or S-glass, either continuous filament or spun and having a denier between about 300 and about 2,000. Fiberglass fibers of this type are manufactured both by Corning and by PPG and are characterized by various properties such as relatively high tenacity, of about 12 to about 20 grams per denier, and by resistance to most acids and alkalies, by being unaffected by bleaches and solvents, and by resistance to environmental conditions such as mildew and sunlight and highly resistant to abrasion and to aging.

The fiber strand which is not made of fiberglass fiber may be nylon 6 or nylon 6,6 or polyester or one of the other fibers referred to above. The preferred denier range may be from about 400 to about 1,500 and the fiber may be filament or spun. Preferably, when nylon is used, it will be a pre-shrunk or low-shrink nylon. When a polyester fiber is utilized, it is characterized by good resistance to most acids except sulfuric acid and good resistance to alkalies except strong alkalies at boiling temperature. Furthermore, polyester exhibits excellent resistance to bleaches and solvents and excellent resistance to mildew, aging and abrasion. Polyester has good resistance to sunlight, but prolonged exposure to sunlight may cause some loss in strength. Nylon, of course, resists weak acids but is degraded by strong oxidizing agents, and nylon is substantially inert in alkalies, nylon generally can be bleached and dyed, and has excellent resistance to mildew, aging and abrasion. Nylon has good resistance to sunlight, although prolonged exposure to sunlight can cause some deterioration.

At this point, it may be helpful to explain some of the benefits of the yarn heretofore described when compared to the yarn of the prior art. By prior art, we are referring to the yarns using aramids plus wire or extended-chain polyethylenes plus wire as described previously in this patent application and in the prior art referred to herein, and as heretofore commercialized for use in cut resistant gloves or cut resistant garments.

There are certain well-known shortcomings when aramid is utilized. Since it is necessary to launder cut resistant gloves, especially if the gloves are being worn in meat processing industries, it must be recognized that aramids have essentially no resistance to bleach. Equally significant and limiting is that aramids do not resist abrasion. A glove, knitted of the yarn of the present invention, which is free of aramid and free of wire, has equivalent cut resistance to a glove knitted of the yarn of wire and aramid of the same total denier plus exhibits resistance to bleaches and substantially higher abrasion resistance.

When comparing a glove knitted from the yarn of the present invention to a glove knitted from yarn of extended-chain polyethylene and wire, according to the aforementioned prior patents, patent applications and commercially available products the glove of the present invention has at least equivalent cut resistance to gloves including wire and extended chain polyethylene of the same denier, and the glove of the present invention can withstand the heat necessary for laundering. The extended-chain polyethylene yarns typically have a maximum temperature or heat limit of approximately 220½ F. after which degradation and/or decomposition take place.

There are several additional benefits of the glove knitted from the yarn of the present invention as compared to gloves made of a yarn comprising aramid and wire and a glove made of a yarn comprising extended-chain polyethylene and wire. For example, wire tends to kink or knuckle and fracture during knitting and during laundering. In addition, when a glove containing wire is slashed with a knife, the wire can be nicked or cut, thus, creating additional wire ends. All of these wire ends can scratch or puncture the skin of the wearer of the glove. If the wire breaks prior to or during the knitting, there can be jamming of the knitting equipment and the resulting waste of yarn and partially-knitted gloves.

The yarn, according to the principles of the present invention, being free of wire, does not have the aforementioned problems, and, in addition, the yarn is softer for the hand, providing better feel and control for the wearer of a glove knitted from such a yarn and is more pliable in the knitting machines.

Perhaps one of the greatest attributes of the yarn of the present invention, as contrasted to the prior art yarn, is that the raw material price of a yarn, according to the principles of the present invention, is about one-fifth to one-sixth of the price of the raw materials for an aramid-wire yarn or an extended-chain polyethylene-wire yarn with the same denier and the same cut or slash resistance.

According to the principles of the present invention, a preferred fiberglass heretofore used is E-glass with a denier of about 650 in the core. The preferred range of denier of the fiberglass is from about 300 to about 2000.

Figure 2:
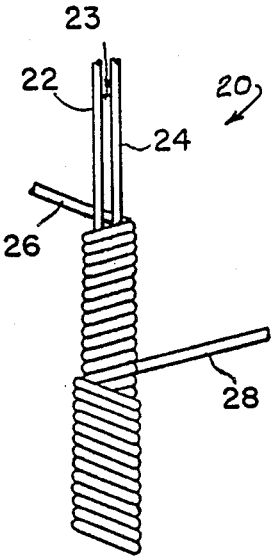

Referring next to FIG. 2, a yarn 20 is illustrated comprising a core and covering. The core is illustrated as comprising three strands 22, 23, 24, which may be parallel, braided or twisted. At least one of the strands is preferably formed of fiberglass. Each of the other two strands may be fiberglass, nylon, polyester or other fiber as heretofore described excluding, of course, aramid and extended chain polyethylene. The covering for the core includes at least two strands 26, 28, wrapped about the core in opposite directions relative to each other such as a first wrap in a clockwise direction and a second wrap in a counterclockwise direction. The covering strands 26, 28 may be fiberglass, nylon or polyester, or the other fibers referred to above. Thus, for the purposes of comparison, the yarn of FIG. 1 may be thought of as comprised of four pieces or four plies or four ends while the yarn of FIG. 2 may be thought of as including five pieces or five plies.

Figure 3:
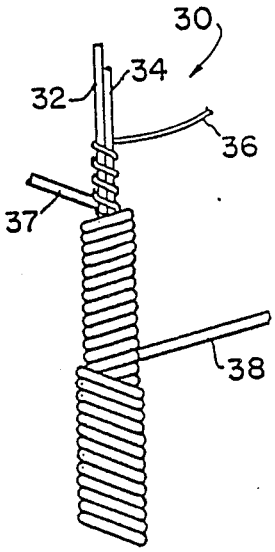

Referring next to FIG. 3, yet another form of the yarn of the present invention is illustrated, this also being a five piece or five ply yarn 30. The yarn 30 includes a core and a covering, the core including two strands 32, 34, at least one of which is fiberglass, and the covering including three strands 36, 37 and 38, two of which are wrapped in the same direction around the core, and the third being wrapped around the core in a direction opposite to the other covering strands. Thus, for the purpose of illustration, the covering comprising strands 36, 37 and 38 includes an innermost covering strand 36 wrapped in a first direction about the core, a second covering strand 37 wrapped around both the core and the first covering strand 36, in a direction opposite to the direction of covering strand 36, and an outermost covering strand 38, wrapped about the covering strand 37 in a direction opposite to the direction of wrapping of covering strand 37 and identical to the direction of the wrapping of covering strand 36.

Figure 4:
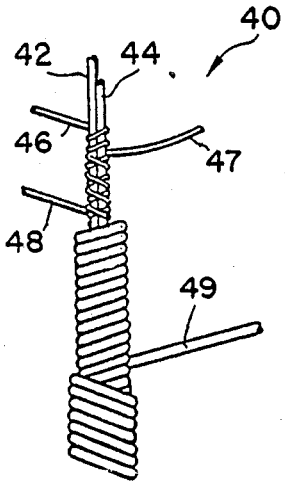
Figure 5:
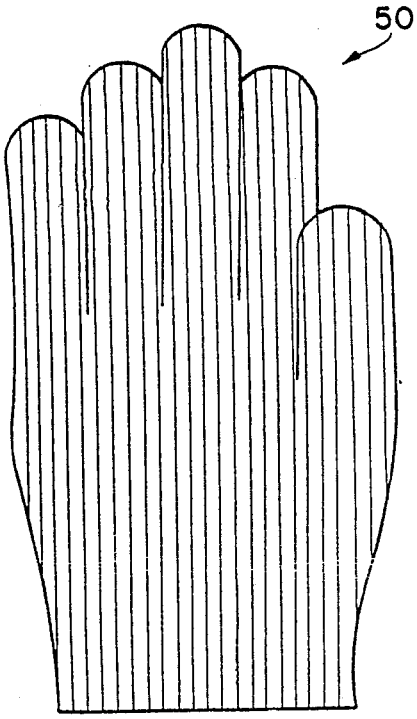
FIG. 5 is an illustration of a protective garment, namely, a glove, made from a yarn according to the principles of the present invention.

Referring next to FIG. 4, a yarn 40 is illustrated as a six piece or six ply yarn. The yarn 40 includes a core and a covering, the core including two strands 42, 44, at least one of which is fiberglass, and the covering including four strands 46, 47, 48 and 49. The covering strands are wrapped about the core, the covering strands are sequentially applied to the core, and each strand is wrapped in the direction opposite to the direction of the immediately preceding cover strand. Thus, in the illustrated embodiment, a first covering strand 46 is wrapped in a first direction about the core, a second covering strand 47 is wrapped about the core in a direction opposite to the direction of the wrapping of cover strand 46, and, of course, covering strand 47 is also wrapped around portions of the covering strand 46. Thereafter, a third covering strand 48 is wrapped around the core in the same direction as covering strand 46 and the third covering strand 48 will, of course, cover not only the core but also covering strands 46 and 47. Lastly, a fourth covering strand 49 is wrapped about the core in the direction opposite to the direction of wrap of covering strand 48 and, hence, in the same direction of wrap as covering strand 47. Covering strand 49 is the outermost wrap and therefore encircles not only the core but all the preceding covering strands.

The yarn, according to the principles of the present invention, may be formed on a standard hollow spindle covering machine with the coverings or wrappings being at the rate of 4–12 turns per inch, with 8 turns per inch being preferred. The yarn according to any of the embodiments of the present invention may be knit into a glove 50 on a conventional knitting machine such as, but not limited to, a Shima Seiki machine. The cut resistant yarn of the present invention may also be woven or knitted to form other protective garments.

The fibers used in the yarn of the present invention should typically have a denier in the range of about 185 to about 2000, with a range of 375 to about 1000 being preferred for the core and a range of 500 to 1000 being preferred for the covering. By way of comparison, if a four ply yarn is provided according to the principles of the present invention, the two core strands may each have a denier of about 650 and the two covering strands may each have a denier of about 1000. Thus the denier of the composite yarn is just over 3500 since denier are not additive because of the wrapping of the covering on the core. A glove knitted of such a yarn has equivalent cut resistance to a yarn made of a core and covering, the core including wire of about 0.0045 inch diameter and a fiber of aramid or extended chain polyethylene and the covering including two wrappings of nylon or extended chain polyethylene or aramid, or combinations thereof, with an equivalent total denier. The preferred total denier of the yarn should generally be in the range of about 3000 to about 6000.

For ease of reference it is pointed out that fibers such as fiberglass, aramids and extended chain polyethylene typically have a tenacity greater than 10 grams per denier while the other fibers referred to herein have a tenacity less than 10 grams per denier.

The foregoing is a complete description of the present invention. Various changes and modifications may be made without departing from the spirit and scope of the invention and, hence, the invention should be limited only by the following claims.

What is claimed is:

1. A non-metallic yarn for use in making strong, flexible products comprising:

a core including at least one strand of fiberglass;

a covering wrapped on said core, said covering including at least two fiber strands wrapped in opposite directions relative to each other around the core, at least one of the covering strands being formed of fiberglass, and at least one of the covering strands being formed of a fiber having a tenacity less than approximately 10 grams per denier.

2. The non-metallic yarn as defined in claim 1 wherein at least one of the covering strands is selected from the group consisting of nylon and polyester.

3. The non-metallic yarn as defined in claim 1 wherein said core includes at least two fiber strands.

4. The non-metallic yarn as defined in claim 3 wherein said core includes at least two fiber strands, one of said fiber strands having a tenacity less than about 10 grams per denier.

5. The non-metallic yarn as defined in claim 1 wherein said core includes at least three strands, at least one of which is formed of fiberglass, the non-fiberglass core strands having a tenacity less than about 10 grams per denier.

6. The non-metallic yarn as defined in claim 1 wherein said covering includes at least three fiber strands wrapped around the core, two of said fiber strands wrapped in opposite directions, relative to each other, around the core, at least one of said covering strands being fiberglass and at least one of said covering strands having a tenacity less than about 10 grams per denier.

7. The non-metallic yarn as defined in claim 1 wherein said covering includes at least two fiber strands wrapped in opposite directions, relative to each other, around the core, and at least two additional fiber strands wrapped in opposite directions, relative to each other, around the core.

8. The non-metallic yarn as defined in claim 7 wherein at least one of the covering strands is fiberglass.

9. The non-metallic yarn as defined in claim 8 wherein all of the covering strands have a tenacity of less than about 10 grams per denier.

10. The non-metallic yarn as defined in any one of claims 1–8 or 9 wherein the fiberglass has a denier in the range of about 300 to about 2,000, and the non-fiberglass strand has a denier in the range from about 400 to about 1,500.

11. The yarn as defined by any one of claims 1–9 wherein the yarn is knitted to form a protective garment.

12. The yarn as defined by any one of claims 1–9 wherein the yarn is used to form a fabric.

13. The yarn as defined by any one of claims 1–9 wherein the yarn is the yarn is used to form a glove.

* * * * *